United States Patent [19]

Goldman

[11] 4,309,677

[45] Jan. 5, 1982

[54] MICROSTRIP "T" TYPE ATTENUATOR NETWORK

[75] Inventor: Mark Goldman, Sudbury, Mass.

[73] Assignee: Alpha Industries, Inc., Woburn, Mass.

[21] Appl. No.: 146,622

[22] Filed: May 5, 1980

[51] Int. Cl.[3] ..... H01P 1/22

[52] U.S. Cl. ..... 333/81 A; 333/246

[58] Field of Search ..... 338/306, 307, 309, 312, 338/313; 333/22 R, 81 R, 81 A

[56] References Cited

U.S. PATENT DOCUMENTS

| | | | |
|---|---|---|---|
| 2,994,049 | 7/1961 | Weinschel | 333/81 A |
| 3,405,382 | 10/1968 | Wright | 338/309 X |
| 3,582,842 | 6/1971 | Friedman | 333/81 A |
| 3,678,417 | 7/1972 | Ragan et al. | 333/22 R |
| 3,775,725 | 11/1973 | Endo | 338/312 X |

*Primary Examiner*—Paul L. Gensler

*Attorney, Agent, or Firm*—Charles Hieken

[57] ABSTRACT

Several strips of resistive material are deposited on a top surface of a dielectric substrate having an opposite bottom surface substantially covered by a conducting material. A strip of conducting material is also deposited on the top substrate surface in electrical contact with the strips of resistive material. At least one of the strips of resistive material is electrically connected to the conducting material on the bottom substrate surface.

3 Claims, 4 Drawing Figures

MICROSTRIP "T" TYPE ATTENUATOR NETWORK

This invention relates to attenuator networks, and more particularly to attenuator networks operable at microwave frequencies characterized by low parasitics that may be readily incorporated into microstrip and other circuits.

Referring to FIG. 1, there is shown a schematic diagram of a known "T" type unbalanced electrical attenuator network 10 including resistors $R_1$, $R_2$ and $R_3$. The attenuator network 10 is arranged to provide a predetermined dissipation of electrical energy when electrically connected between an electrical energy source 12 having a resistive impedance $Z_1$ and a load 14 having a resistive impedance $Z_2$. The resistance of resistors $R_1$, $R_2$ and $R_3$ are selected so that the input and output impedances of attenuator network 10 match the source and load impedances $Z_1$ and $Z_2$, respectively.

Resistors $R_1$ and $R_2$ are serially connected between input 16 and output terminals 18 of attenuator network 10. A resistor $R_3$ is connected between the junction 20 of resistors $R_1$ and $R_2$ and grounded line 22. The method for determining the values of $R_1$, $R_2$ and $R_3$ for a specified attenuation and input and output impedance is well-known and disclosed in a book entitled "Reference Data for Radio Engineers", 5th edition, published by Howard W. Sams & Co.

The typical prior art approach for fabricating T and $\pi$ attenuators for use in a microstrip circuit involves assembling chip resistors in series and shunt. Not only is assembly cumbersome, but this approach severely limits the operating bandwidth and frequency. It is difficult to achieve a good ground return for the shunt resistor at high microwave frequencies. Furthermore, the parasitics of additional line length and inductance introduced by the shunt resistor and its connection to ground limit the useful operating frequency range of this approach.

It is an important object of this invention to provide an improved microwave attenuator.

It is a further object of the invention to achieve the preceding object for use in a microstrip circuit.

It is a further object of the invention to achieve one or more of the preceding objects while overcoming one or more of the problems described above.

It is a further object of the invention to achieve one or more of the preceding objects with structure that facilitates assembly.

It is a further object of the invention to achieve one or more of the preceding objects while establishing a ground return for the shunt resistance at higher frequencies.

It is still another object of the invention to achieve one or more of the preceding objects while reducing parasitics.

According to the invention, microwave attenuating apparatus comprises a dielectric substrate having a top surface and a bottom surface. A ground conducting material substantially covers the bottom substrate surface. First, second, and third strips of resistive material are deposited on the top substrate surface. A strip of conducting material is deposited on the top substrate surface in electrical contact with the first, second and third strips of resistive material. Means electrically connect the third strip of resistive material to the ground conducting material on the bottom substrate surface.

This structure may then be in series with microstrip transmission lines.

Numerous other features, objects and advantages of the invention will become apparent from the following specification when read in conjunction with the accompanying drawing in which.

Figure 2:
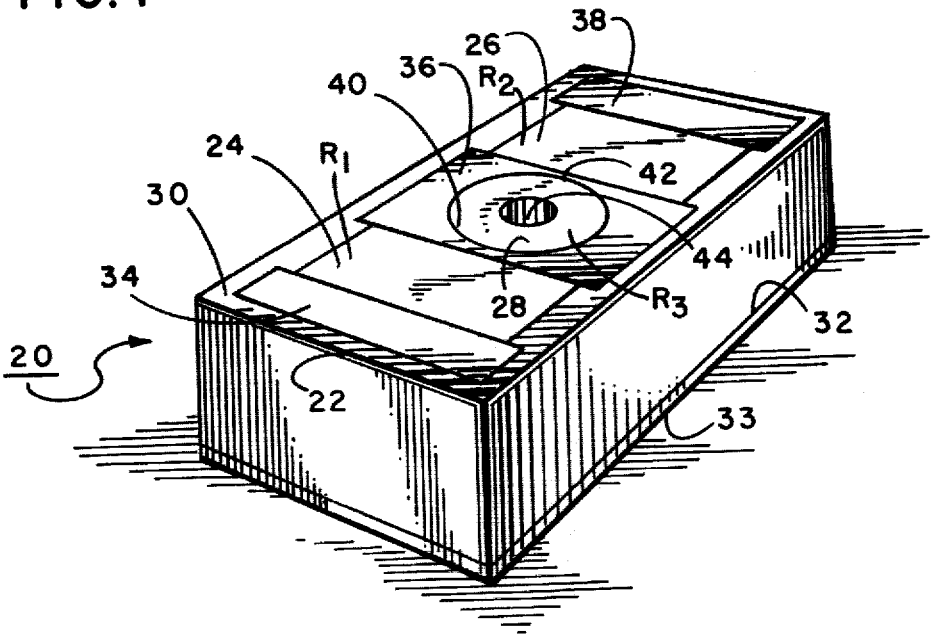
FIG. 2 is an isometric view of a "T" type microwave attenuator network arranged according to the invention.

Referring to FIG. 2 there is shown an isometric view of a "T" type attenuator network 20 arranged according to the invention to operate at microwave frequencies. The attenuator network 20 includes a substrate 22 of dielectric material, such as alumina, having first 24, second 26, and third 28 strips of lossy or resistive material deposited on a top substrate surface 30 by thick or thin film techniques. The resistance of the resistive strips 24, 26, 28 is substantially proportional to the resistivity of the material forming the strips and the strip surface area. An opposite or bottom substrate surface 32 is substantially covered by a conducting material 33, such as copper, normally connected to reference or ground potential.

Figure 1:
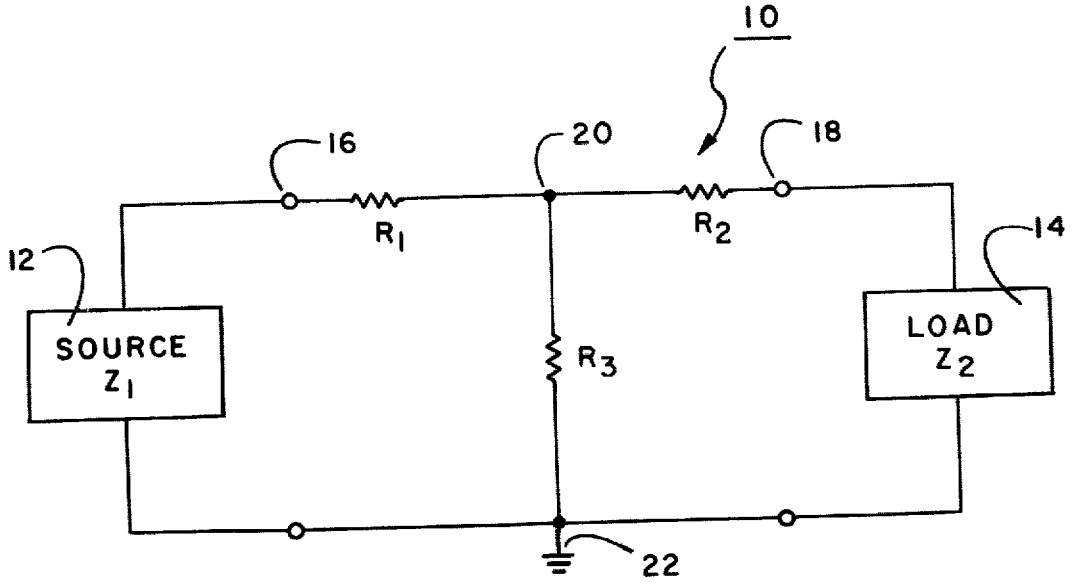
FIG. 1 is a schematic drawing of a prior art "T" type attenuator network.

The first resistive strip 24 is deposited in a space between first 34 and second 36 strips of conducting material formed on the top substrate surface 30 so that opposite edges of the first resistive strip is electrically connected to adjacent edges of the conductive strips 34, 36. The first strip 34 of conducting material forms an input terminal for receiving microwave energy. The resistance of the first resistive strip 24 is substantially equal to the resistance of the resistor $R_1$ in FIG. 1.

The second resistive strip 26 is deposited in a space between the second conductive strip 36 and a third strip 38 of conducting material. The third strip 38 of conducting material forms an output terminal for transmitting microwave energy. Opposite edges of the second resistive strip 26 are electrically connected to adjacent edges of the conductive strips 36, 38, whereby the second conductive strip 36 provides a junction between the first 24 and second 26 resistive strips. The resistance of the second resistive strip 26 is substantially equal to the resistance of the resistor $R_2$ in FIG. 1.

The third resistive strip is deposited in a circular void formed by chemical etching or other known techniques in the second conductive strip 36. The outside edge 40 of the third resistive strip is electrically connected to an adjacent edge 42 of the second conductive strip 36. The resistance of the third resistive strip 28 is substantially equal to the resistance of resistor $R_3$ in FIG. 1.

A through hole 44 extends from substantially the center of the third resistive strip 28 to the conducting material 33 on the opposite substrate surface 32. The hole 44 is plated with conducting material so as to provide a conductive path between the third resistive strip 28 and the conducting material 33 on the opposite substrate surface 32, whereby the third resistive strip 28 is electrically connected between the junction of the first 24 and second 26 resistive strips and ground potential.

It has been empirically determined that the plated through hole 44 connecting the third resistive strip 28 to ground potential minimizes undesired parasitic impedances normally encountered in prior art attenuator networks.

Figure 3:
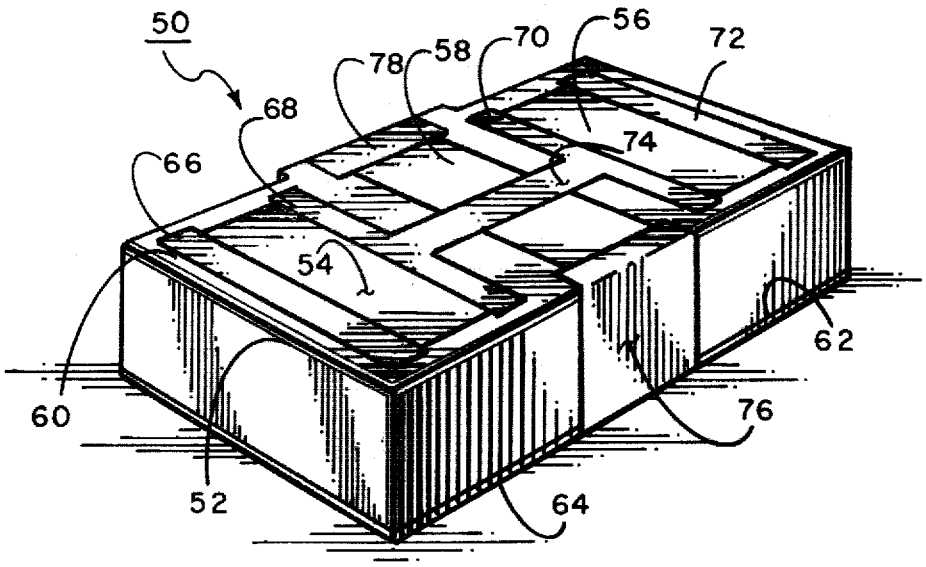
FIG. 3 is an isometric view of another embodiment of a "T" type microwave attenuator network arranged according to the invention.

Referring to FIG. 3, there is shown an isometric view of another embodiment of a T-attenuator network 50 arranged according to the invention. The attenuator network 50 includes a substrate of dielectric material 52 having first 54, second 56, and third 58 strips of resistive material deposited on a top substrate surface 60. The resistance of the resistive strips 54, 56, 58 is substantially proportional to the resistivity of the material forming the strips and the strip surface area. An opposite or bottom substrate surface 62 is substantially covered by a conducting material 64 normally connected to reference or ground potential.

The first resistive strip 54 is deposited in a space between first 66 and second 68 strips of conducting material formed on the top substrate surface 60 so that opposite edges of the first resistive strip 54 is electrically connected to adjacent edges of the conductive strips 66, 68. The resistance of the first resistive strip 54 is substantially equal to the resistance of the resistor $R_1$ in FIG. 1.

The second resistive strip 56 is deposited in a space between third 70 and fourth 72 strips of conducting material deposited on the top substrate surface 60 so that opposite edges of second resistive strip 56 is electrically connected to adjacent edges of the conductive strips 70, 72. The resistance of the second resistive strip 56 is substantially equal to the resistance of the resistor $R_2$ in FIG. 1.

The third resistive strip 58 is deposited in a space between the second 68 and third 70 strips of conducting material so that opposite edges of the third resistive strip 58 are not contiguous with adjacent edges of the second 68 and third 70 strips of conducting material. A fifth strip 74 of conducting material is deposited on the top substrate surface 60 to extend across and in electrical contact with the third resistive strip 58. Opposite ends of the fifth strip 74 of conducting material are respectively connected electrically to the second 68 and third 70 strips of conducting material, whereby the fifth strip 74 of conductive material provides a junction between the first 54 and second 56 resistive strips. The resistance of the third resistive strip 58 is substantially equal to 2X the resistance of the resistor $R_3$ in FIG. 1, the two halves in parallel being $R_3$.

A pair of conductive strips 76, 78 extend over an edge of the substrate 52 from opposite ends of the third resistive strip 58 to the conducting material 64 on the opposite substrate 62, whereby the third resistive strip 58 is electrically connected between the junction of the first 54 and second 56 resistive strips and ground potential.

Figure 4:
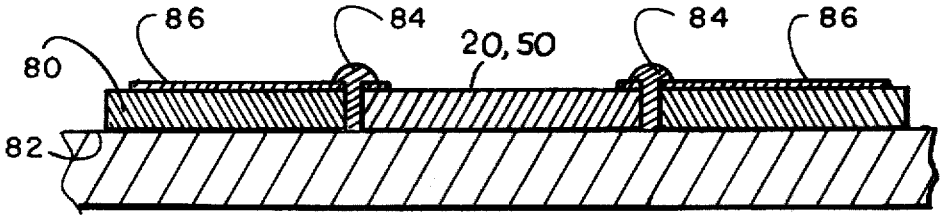
FIG. 4 is a cross sectional view of a microwave attenuator network assembled in a microstrip transmission line.

Under operating conditions, the attenuator network 20 or 50 is assembled in place of a dielectric substrate 80 of a microwave transmission line, such as microstrip, as shown in cross section in FIG. 4. The conducting material 33 or 64 on the bottom substrate surface 32 or 62 of the network attenuator 20 or 50 is electrically connected to a conductive surface 82 of the transmission line at ground potential by soldering or use of conductive epoxy. Strips of conducting material 84 may be bonded or soldered between the input 34 or 66 and output 38 or 72 terminals of the attenuator network 20 or 50 and the center conductor 86 of the microwave transmission line, whereby microwave energy may be received and transmitted by the attenuator network 20 or 50.

The principles of the invention may be readily adapted for a $\pi$ network in which there is a resistance connected between input 16 and output 18 and a resistance connected between input 16 and ground line 22 and between output 18 and ground line 22. The embodiment of FIG. 2 may be readily adapted by having assemblies like resistive strip 40, conducting strip 36 and plated through opening 44 at the input and output interconnected by a resistive strip such as 24 or 26. Similarly, the embodiment of FIG. 3 may be readily adapted by having resistive strips such as 58 and the grounding conductors such as 76 and 78 shifted to the ends of substrate 52 interconnected by a resistive strip such as 54 or 56.

There has been described novel apparatus and techniques for providing a microwave attenuator that may be readily assembled in a microwave strip line while reducing parasitics and capable of operating over a relatively large frequency range extending into the higher microwave frequencies. It is evident that those skilled in the art may now make numerous uses and modifications of and departures from the specific embodiments described herein without departing from the inventive concepts. Consequently, the invention is to be construed as embracing each and every novel feature and novel combination of features present in or possessed by the apparatus and techniques herein disclosed and limited solely by the spirit and scope of the appended claims.

What is claimed is:

1. Microwave attenuating apparatus comprising, a dielectric substrate having a top surface and a bottom surface each generally rectangular and characterized by length and width and separated by the substrate thickness, grounding conducting material substantially covering said bottom substrate surface, first, second and third spaced strips of resistive material deposited on said top surface, at least said first and second resistive strips being generally parallel to each other with the length of each of said first and second resistive strips extending along most of the width of said top surface, said third resistive strip being between said first and second resistive strips, first and second end conducting strips on said top surface in conductive contact with a lengthwise outside edge of said first and second resistive strips respectively along most of the width of said top surface and adjacent to respective opposed widthwise edges of said top surface, and conducting material interconnecting said first, second and third strips of resistive material and said grounding conducting material to establish a predetermined attenuation between an input defined by said first strip of resistive material and said grounding conducting material and an output defined by said second strip of resistive material and said grounding conducting material, said conducting material including an intermediate conducting strip having first and second edges in conductive contact with a lengthwise inside edge of said first and second resistive strips respectively, and at least one transverse conducting strip in conductive contact with an edge of said third resistive strip and said grounding conducting material of length substantially equal to the substrate thickness, said transverse conducting strip surrounding an opening in said substrate surrounded at the top by said third resistive strip.

2. Microwave attenuating apparatus comprising, a dielectric substrate having a top surface and a bottom surface each generally rectangular and characterized by length and width and separated by the substrate thickness, grounding conducting material substantially covering said bottom substrate surface, first, second and third spaced strips of resistive material deposited on said top surface, at least said first and second resistive strips being generally parallel to each other with the length of each of said first and second resistive strips extending along most of the width of said top surface, said third resistive strip being between said first and second resistive strips, first and second end conducting strips on said top surface in conductive contact with a lengthwise outside edge of said first and second resistive strips respectively along most of the width of said top surface and adjacent to respective opposed widthwise edges of said top surface, and conducting material interconnecting said first, second and third strips of resistive material and said grounding conducting material to establish a predetermined attenuation between an input defined by said first strip of resistive material and said grounding conducting material and an output defined by said second strip of resistive material and said grounding conducting material, said conducting material including an intermediate conducting strip having first and second edges in conductive contact with a lengthwise inside edge of said first and second resistive strips respectively, and at least one transverse conducting strip in conductive contact with an edge of said third resistive strip and said grounding conducting material of length substantially equal to the substrate thickness, wherein inside edges of said first and second resistive strips and an outside edge of said third resistive strip are interconnected by said intermediate conducting strip on said top surface, and an inside edge of said third resistive strip is connected to said grounding conducting material by said transverse conducting strip extending between said first and second surfaces perpendicular thereto.

3. Microwave attenuating apparatus in accordance with claim 2 wherein said third resistive strip is annular having an outer circumferential edge being said outside edge and an inner circumferential edge being said inside edge surrounding an opening formed in said substrate extending between said top and bottom surface surrounded by a wall plated with conducting material forming said transverse conducting strip.

* * * * *